United States Patent [19]

Nakahara et al.

[11] Patent Number: 5,002,281

[45] Date of Patent: Mar. 26, 1991

[54] THREE-PIECE SOLID GOLF BALL

[75] Inventors: Akihiro Nakahara, Ibaraki; Mikio Yamada, Kobe; Tadahiro Ebisuno, Nishinomiya; Kengo Oka, Kobe; Takashi Sasaki, Nishinomiya, all of Japan

[73] Assignee: Sumitomo Rubber Industries, Ltd., Hyogo, Japan

[21] Appl. No.: 485,656

[22] Filed: Feb. 27, 1990

[30] Foreign Application Priority Data

Mar. 1, 1989 [JP] Japan ..... 1-49025

[51] Int. Cl.[5] ..... A63B 37/12

[52] U.S. Cl. ..... 273/220; 273/218; 273/235 R; 273/230

[58] Field of Search ..... 273/218, 220, 62, 230, 273/231, 235 R, 230, 228, 229

[56] References Cited

U.S. PATENT DOCUMENTS

| | | | |
|---|---|---|---|
| 3,313,545 | 4/1967 | Bartsch | 273/218 |
| 3,784,209 | 1/1974 | Berman et al. | 273/218 |
| 4,570,937 | 2/1986 | Yamada | 273/218 |
| 4,625,964 | 12/1986 | Yamada | 273/220 |
| 4,919,434 | 4/1990 | Saito | 273/218 |

FOREIGN PATENT DOCUMENTS

| | | | |
|---|---|---|---|
| 62-181069 | 8/1987 | Japan | 273/218 |
| 63-61029 | 11/1988 | Japan | 273/218 |
| 2139101 | 11/1984 | United Kingdom | 273/220 |

*Primary Examiner*—George J. Marlo

*Attorney, Agent, or Firm*—Birch, Stewart, Kolasch & Birch

[57] ABSTRACT

Disclosed is a three-piece solid golf ball comprising a solid core consisting of an inner core and an outer shell surrounding said inner core, and a cover covering said solid core, characterized in that a diameter of said inner core is 29 to 36 mm, a diameter of said solid core is 37 to 41 mm, a central hardness (JIS-C) of the inner core is 25 to 70, a surface hardness (JIS-C) of said outer shell is 80 to 95, a difference between said central hardness of the inner core and said surface hardness of the outer shell is 10 or more, and the relation between the specific gravity of the inner core and the specific gravity of the outer shell satisfies 1.0 $<$ a specific gravity of the inner core $\leqq$ a specific gravity of the outer shell $<$ 1.3.

3 Claims, 1 Drawing Sheet

FIGURE
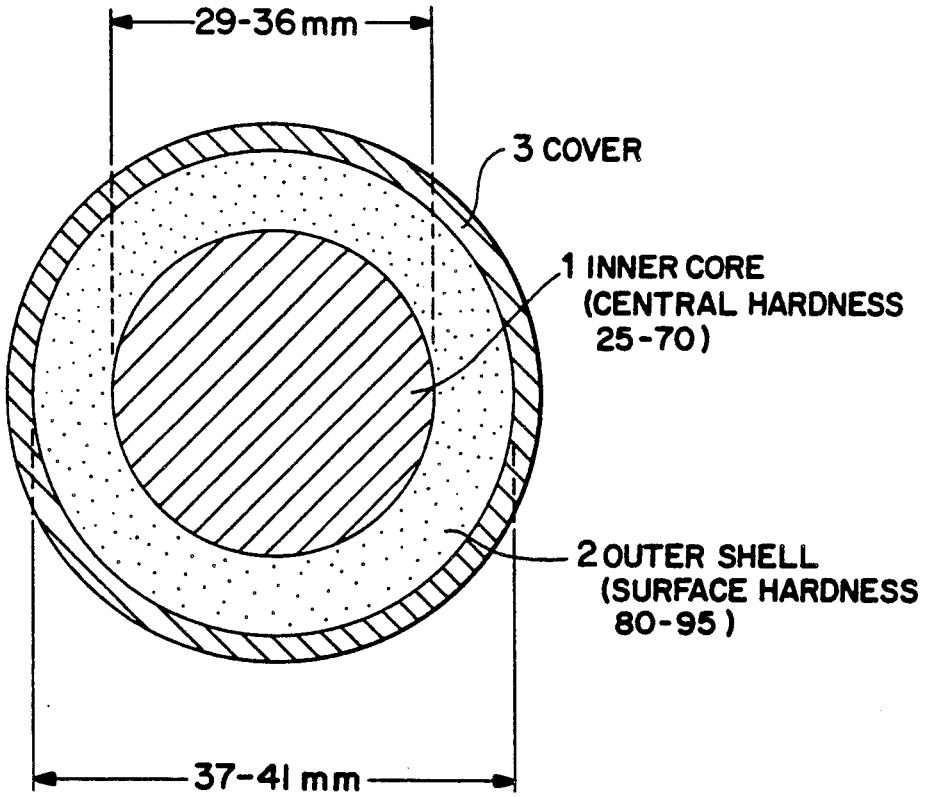

THREE-PIECE SOLID GOLF BALL

FIELD OF THE INVENTION

The invention relates to a large-sized three-piece solid golf ball superior in impact resilience and flying distance.

BACKGROUND OF THE INVENTION

A large number of patent applications have been made for three-piece solid golf balls, but those, in particular, with a large size, superior to a two-piece golf ball in performance, that is impact resilience, flying distance and hit feeling which are important for golf balls, have not been developed yet.

For example, Japanese Patent Publication (examined) No. 61029/1988 proposes that a lower specific gravity is given to an inner layer (inner core) of a solid core and a higher specific gravity is given to an outer layer (outer shell) of the solid core to give a differential specific gravity, whereby obtaining high impact resilience and good hit feeling. For small size golf balls, the high impact resilience has been obtained because a sufficient specific gravity difference can be obtained, however, for large size golf balls satisfactory impact resilience, flying distance and hit feeling have not been obtained yet. In addition, according to Japanese Kokai Application No. (unexamined) 181069/1987, a diameter of a solid core is relatively reduced to an extent of 24 to 29 mm and a differential specific gravity is given between an inner layer having a higher specific gravity and an outer layer having a lower specific gravity to obtain increased flying distance, good hit feeling and controllability. However, impact resilience and flying distance have not exceeded those of the two-piece golf ball, which has been used at present. Furthermore, since TMPT (U.S. Pat. No. 3,313,545), which has been hardly used at present, is used in the inner layer, the three-piece golf balls according to Japanese Kokai Application 181069/1987 are remarkably inferior to the two-piece golf ball, which has been used at present, in durability.

Besides, according to Japanese Kokai Publication No. 241464/1985, a differential specific gravity is given between an inner layer having a larger specific gravity and an outer layer having a lower specific gravity in the same manner as in the above described Japanese Kokai Application No. 181069/1987 and the inner layer is made softer to reduce a moment of inertia of a ball, whereby obtaining the high impact resilience and the good hit feeling. This ball is satisfactory in hit feeling, but inferior to the two-piece golf ball in maximum impact resilience.

SUMMARY OF THE INVENTION

The present inventors have found from their investigation of three-piece solid golf balls that the conventionally proposed three-piece golf balls are all suitable for small-sized golf balls but not always suitable for large-size golf balls. That is to say, it is thought that the large-size golf ball required a construction peculiar thereto.

It is an object of the present invention to develop a large-size three-piece golf ball having impact resilience higher than that of the conventional two-piece golf ball and improved hit feeling, and flying capacity such as flying distance. The golf ball comprises a solid core consisting of an inner core and an outer shell surrounding the inner core, and a cover covering the solid core, characterized in that a diameter of the inner core is 29 to 36 mm, a diameter of the solid core is 37 to 41 mm, a central hardness (JIS-C) of the inner core is 25 to 70, a surface hardness (JIS-C) of the outer shell is 80 to 95, a difference between the central hardness of the inner core and the surface hardness of the outer shell is 10 or more, and the relation between the specific gravity of the inner core and the specific gravity of the outer shell satisfies 1.0<a specific gravity of the inner core≦a specific gravity of the outer shell<1.3.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein:

The FIGURE shows the three-piece solid golf ball of the present invention, wherein element 1 represents the inner core, element 2 represents the outer shell and element 3 represents the golf ball cover.

DETAILED DESCRIPTION OF THE INVENTION

In general, the inner core (1) and the outer shell (2) constituting the solid core of the three-piece solid golf ball may be suitably changed in rubber composition within the scope of the present invention if desired. The rubber composition of the solid core generally comprises a base rubber, a cross-linking agent, a cocross-linking agent, fillers and the like.

The base rubber can be natural rubber and/or synthetic rubber, but 1,4-polybutadiene containing a cis-structure in a quantity of at least 40% or more is in particular useful in the present invention. A natural rubber, a polyisoprene rubber, a styrene butadiene rubber and the like may be suitably added to the polybutadiene if necessary.

The cross-linking agent includes organic peroxides, such as dicumyl peroxide and t-butyl peroxide; azo compounds, such as azo-bis-isobutylnitrile; and the like. Dicumyl peroxide is in particular preferably used. The cross-linking agent is used in a quantity of 0.5 to 3.0 parts by weight, preferably 1.0 to 2.5 parts by weight, based on 100 parts by weight of the base rubber.

The cocross-linking agent is not specially limited, but metallic salts of unsaturated fatty acids, in particular a zinc salt and a magnesium salt of unsaturated fatty acids containing 3 to 8 carbon atoms (for example acrylic acid, methacrylic acid and the like), can be employed. Zinc acrylate (normal salt) is in particular preferably used. It is used in a quantity of 5 to 25 parts by weight for the inner core, 25 to 50 parts by weight for the outer shell, based on 100 parts by weight of the base rubber.

The fillers may be zinc oxide, barium sulfate, silica, calicium carbontae, zinc carbonate and the like, but zinc oxide is more general. They are used in a quantity depending upon the specific gravities of the inner core and outer shell, the weight standard of the ball and the like but not specially limited, generally 3 to 150 parts by weight based on 100 parts by weight of the base rubber.

A rubber composition for the inner core of the solid core can be obtained by mixing the above described ingredients in a usual blender, for example a Banbury mixer, a roll and the like. The resulting blend is compression molded or injection molded in a metal mold for the inner core followed by heating at a temperatures sufficient for the action of the cross-linking agent and the cocross-linking agent (for example about 150° to 170° C. in the case where dicumyl peroxide is used as the cross-linking agent and zinc acrylate is used as the cocross-linking agent) to harden the molded product, whereby producting the inner core of the solid core having a diameter of 29 to 36 mm, preferably 30 to 34 mm, and a specific gravity of 1.0 to 1.3. If the diameter of the inner core is less than 29 mm, the shock when hit the ball is increased and the hit feeling is deteriorated while if it exceeds 36 mm, the thickness of the outer shell is reduced, whereby the hit feeling is too soft and also the durability is reduced.

In this case, it is important to suitably adjust the heating-hardening conditions (for example the temperature-rise rate, the heating temperature, the heating time and the like) so that the hardness (JIS-C) of the inner core of the solid core may amount to 25 or more but less than 70, preferably 40 to 65, at the center thereof. If the hardness at the center is less than 25, the hit feeling is too soft the impact resilience is deteriorated. If the hardness is more than 70, the ball is too hard and the hit feeling is bad, whereby the ball can not be practically used.

The solid core according to the present invention is produced by further forming the outer shell on the inner core obtained above.

That is to say, the rubber composition for the outer shell of the solid core is obtained by mixing and blending the above mentioned ingredients and concentrically compression molded on the inner core. The resulting two-layer molded product is heated to be hardened at the temperatures sufficient for the action of the cross-linking agent and the cocross-linking agent contained in the outer shell to obtain the solid core having a diameter of 37 to 41 mm. If the diameter of the solid core is 37 mm or less, the cover is too thick and thus the impact resilience is reduced, while if it is 41 mm or more, the cover is too thin and thus the durability is deteriorated.

The surface hardness (JIS-C) of the outer shell is set at 80 to 95, preferably 85 to 92. If the surface hardness of the outer shell is less than 80, the impact resilience is deteriorated, while if it exceeds 95, the impact resilience is improved but the durability is deteriorated.

According to the present invention, it is required that the difference between the hardness at the center of the inner core and the surface hardness of the outer shell is 10 or more. In other words, it is preferably that the inner core is considerably softer than the outer shell. According to the investigation by the present inventors, the shock when the ball is hit is reduced with a reduction of the hardness of the inner core and the impact resilience is improved with an increase of the hardness of the outer shell. If the above described difference is less than 10, the impact resilience is reduced and the shock when the ball is hit is increased.

According to the present invention, also the specific gravities of the inner core and the outer shell are important and it is required that the relation between both specific gravities satisfies the following expression (1):

$$1.0 < \text{specific gravity of the inner core} \leqq \text{specific gravity of the outer shell} < 1.3 \quad (1)$$

It has been found that, although the increased difference between the specific gravity of the inner core and that of the outer shell is preferable for the small-size ball, the impact resilience is hardly influenced by the distribution of specific gravity for the large-size ball. In respect of the shock when the ball is hit, it is rather preferable that the specific gravity shows no distribution (specific gravity of the inner core $\approx$ specific gravity of the outer shell). Accordingly, in view of the impact resilience and the shock when the ball is hit, it is necessary to meet the above described expression (1).

With the above described construction, the large-size three-piece golf ball with the reduced quantity of spin influencing upon the fly of the ball and the tendency to increase the hitting-up angle and thus showing the flying distance exceeding that of two-piece golf balls and the good feeling was obtained.

The two-piece solid core obtained in the above described manner is covered with a cover of 0.9 to 2.9 mm thick. The cover is generally formed from mainly ionomer resins and if necessary, inorganic fillers (for example titanium dioxide, zinc oxide and the like).

The preferable ionomer resins are thermoplastic resins obtained from polymers of monoolefines and at least one kind selected from the group consisting of unsaturated mono- or dicarboxylic acids containing 3 to 8 carbon atoms and esters thereof (containing unsaturated mono- or dicarboxylic acids, and/or esters thereof in a quantity of 4 to 30% by weight), which contains metallic cross bonds. The ionomer resins include various kinds of "Surlyn" (for example Surlyn 1601, 1707, 1605 and in combination) marked by DuPont de Nemours & Co., Ltd.

A method of covering the solid core with the cover is not specially limited. In usual, the solid core is covered with two pieces of cover, which have been previously molded in the shape of a semispherical shell, followed by heating and compression molding. However, the composition for the cover may be injection molded to cover the solid core.

The large-size three-piece solid golf ball obtained in the present invention exhibits impact resilience higher than that of the conventional two-piece golf ball, good hit feeling and improved flying capacities such as flying distance.

EXAMPLES

The present invention is below described with reference to the preferred examples but not limited by them. In addition, the positions, where the distribution of hardness is measured, are all specified with the center as a base. For example, 5 to 10 mm indicates the position at a distance of 5 to 10 mm from the center.

EXAMPLES 1 TO 5

The compositions for the inner core of the solid core shown in Table 1 were subjected to the pressure molding for 30 minutes at 155° C. to produce inner cores.

The compositions for the outer core of the solid core shown in Table 1 were concentrically pressure molded on the above described inner cores and then heated for 30 to 40 minutes at 155° C. to obtain two-piece solid cores.

The resulting two-piece solid cores were covered with the compositions for the covers shown in Table 1 by the injection molding to produce large-size three-piece solid golf balls.

The physical properties of the produced balls are shown in Table 1.

COMPARATIVE EXAMPLES 1 TO 7

Three-piece solid golf balls were obtained in the same manner as in Example 1 using the compositions shown in Table 1. The physical properties of the obtained golf balls are shown in Table 1.

Comparative Examples 1 to 3 and 7 relate to the golf balls having the diameter of the inner core of less than 29 mm, Comparative Examples 2, 6 and 7 relating to the golf balls in which the specific gravity of the inner core is larger than that of the outer core, comparative Example 4 relating to the golf ball in which the inner core has the hardness of less than 25 at the center thereof and the hardness of less than 40 at the distance of 5 to 10 mm form the center thereof, and Comparative Example 5 relating to the golf ball in which the inner core has the hardness of 70 or more at the center thereof and the hardness of 70 or more at the distance of 5 to 10 mm from the center thereof.

COMPARATIVE EXAMPLE 8

The first-class two-piece golf ball on the market was tested on physical properties. The results are shown in Table 1.

TABLE 1

| | | | | Examples No. | | | | | Comparative Examples No. | | | | | | | |
|---|---|---|---|---|---|---|---|---|---|---|---|---|---|---|---|---|
| | | | | 1 | 2 | 3 | 4 | 5 | 1 | 2 | 3 | 4 | 5 | 6 | 7 | 8 |
| Solid core | Inner layer | Composition (parts by weight) | Cis-1,4-polybutadiene[1] | 100 | 100 | 100 | 100 | 100 | 100 | 100 | 100 | 100 | 100 | 100 | 100 | * |
| | | | Zinc acrylate | 7 | 13 | 13 | 20 | 22 | 12 | 12 | 13 | 4 | 25 | 13 | — | |
| | | | TMPT | — | — | — | — | — | — | — | — | — | — | — | 13 | |
| | | | Zinc oxide | 29.5 | 27.3 | 21.0 | 24.9 | 24.2 | 27.7 | 57.0 | 27.3 | 30.5 | 23.1 | 51.6 | 64.8 | |
| | | | N,N-phenylene-maleimide | — | — | — | — | — | — | — | — | — | — | — | 2 | |
| | | | Antiaging agent | 0.5 | 0.5 | 0.5 | 0.5 | 0.5 | 0.5 | 0.5 | 0.5 | 0.5 | 0.5 | 0.5 | 1.0 | |
| | | | Dicumyl peroxide | 1.5 | 1.5 | 1.6 | 1.5 | 1.5 | 1.5 | 1.4 | 1.5 | 1.0 | 1.5 | 1.5 | 1.2 | |
| | | Diameter (mm) | | 31.0 | 31.0 | 31.0 | 31.0 | 34.2 | 24.2 | 24.2 | 27.1 | 31.0 | 31.0 | 31.0 | 24.2 | |
| | | Specific gravity | | 1.151 | 1.151 | 1.110 | 1.151 | 1.151 | 1.151 | 1.332 | 1.151 | 1.151 | 1.151 | 1.301 | 1.332 | |
| | | Central hardness (JIS-C) | | 30 | 50 | 51 | 60 | 62 | 45 | 44 | 50 | 20 | 71 | 50 | 45 | |
| | | 5 to 10 mm hardness (JIS-C) | | 45 | 60 | 62 | 68 | 70 | 48 | 46 | 61 | 38 | 75 | 57 | 46 | |
| Solid core | Outer layer | Composition (parts by weight) | Cis-1,4-polybutadiene | 100 | 100 | 100 | 100 | 100 | 100 | 100 | 100 | 100 | 100 | 100 | 100 | 100 |
| | | | Zinc acrylate | 45 | 45 | 40 | 47 | 48 | 40 | 40 | 45 | 45 | 45 | 28 | 40 | |
| | | | Zinc oxide | 16.0 | 16.0 | 35.9 | 15.3 | 15.0 | 17.8 | 13.6 | 16.0 | 16.0 | 16.0 | 4.7 | 13.6 | |
| | | | Antiaging agent | 0.5 | 0.5 | 0.5 | 0.5 | 0.5 | 0.5 | 0.5 | 0.5 | 0.5 | 0.5 | 0.5 | 0.5 | |
| | | | Dicumyl peroxide | 1.5 | 1.5 | 1.5 | 1.5 | 1.5 | 1.5 | 1.5 | 1.5 | 1.5 | 1.5 | 2.4 | 1.5 | |
| | | Specific gravity | | 1.151 | 1.151 | 1.252 | 1.151 | 1.151 | 1.151 | 1.127 | 1.151 | 1.151 | 1.151 | 1.044 | 1.127 | — |
| | | Surface hardness (JIS-C)[2] | | 90 | 91 | 85 | 93 | 94 | 85 | 86 | 90 | 91 | 91 | 78 | 86 | — |
| | | Diameter of the core (mm) | | 38.4 | 38.4 | 38.4 | 38.4 | 38.4 | 38.4 | 38.4 | 38.4 | 38.4 | 38.0 | 38.4 | 38.4 | — |
| Cover | Composition (wt. parts) | | Ionomer resin[3] | 100 | 100 | 100 | 100 | 100 | 100 | 100 | 100 | 100 | 100 | 100 | 100 | — |
| | | | Titanium dioxide | 3 | 3 | 3 | 3 | 3 | 3 | 3 | 3 | 3 | 3 | 3 | 3 | — |
| | Thickness (mm) | | | 2.2 | 2.2 | 2.2 | 2.2 | 2.4 | 2.2 | 2.2 | 2.2 | 2.2 | 2.2 | 2.2 | 2.2 | 2.2 |
| | Hardness (shore D) | | | 70 | 70 | 70 | 70 | 70 | 70 | 70 | 70 | 70 | 70 | 70 | 70 | 70 |
| Physical Propertie | Weight of the ball (g) | | | 45.3 | 45.3 | 45.4 | 45.3 | 45.3 | 45.4 | 45.2 | 45.3 | 45.3 | 45.4 | 45.3 | 45.3 | 45.2 |
| | Diameter of the ball (mm) | | | 42.70 | 42.71 | 42.72 | 42.71 | 42.69 | 42.71 | 42.72 | 42.70 | 42.71 | 42.72 | 4 | 42.71 | 42.71 |
| | Compression of the ball (PGA) | | | 90 | 105 | 100 | 122 | 125 | 98 | 98 | 104 | 85 | 130 | 90 | 100 | 103 |
| | Impact resilience index[4] | | | 100 | 102 | 101 | 102 | 103 | 97 | 97 | 98 | 96 | 99 | 96 | 96 | 100 |
| | Shock index[5] | | | 77 | 85 | 82 | 88 | 90 | 75 | 75 | 89 | 70 | 105 | 70 | 75 | 100 |
| | Flying distance [Head speed (45 m/s)] | | (carry m) | 211.1 | 213.2 | 213.0 | 214.5 | 215.1 | 208.9 | 209.1 | 209.9 | 206.9 | 210.0 | 205.1 | 208.0 | 210.2 |
| | | | (total m)[6] | 223.3 | 225.4 | 225.1 | 226.8 | 217.7 | 220.7 | 221.4 | 222.0 | 218.8 | 222.0 | 217.3 | 220.1 | 222.1 |
| | Hitting angle (°) | | | 9.45 | 9.35 | 9.37 | 9.33 | 9.42 | 9.25 | 9.27 | 9.20 | 9.21 | 9.15 | 9.11 | 9.27 | 9.20 |
| | Spin (r.p.m.) | | | 2842 | 2855 | 2857 | 2880 | 2840 | 2920 | 2922 | 2980 | 2900 | 3120 | 3302 | 2910 | 3105 |

*The first-class two-piece golf ball on the market

[1]BR-11 (manufactured by Japan Synthetic Rubber Co., Ltd.)

[2]The hardness is measured with holding the JIS-C type hardness tester vertically to the surface of the core in accordance with JIS-K-6301

[3]The mixture of Surlyn 1605 and Surlyn 1706.

[4]The impact resilience factor calculated from the speed of the core or the ball when the metallic cylinder having a weight of 198.4 g comes into collision with the ball at a speed of 45 m/s and expressed with that in Comparative Example 8 as 100.

[5]The index expressing the maximum shock calculated from the measured change of accerelation of the club with that in Comparative Example 8 as 100.

[6]The ball is hit at a head speed of 45 m/s by means of the swing M/C manufactured by Through Temper Corporation and the flying distance until the spot, where the ball has dropped, is measured as the carry (m) and the flying distance until the spot, where the ball has stopped to roll, is measured as the total (m).

It is found from Comparative Example 1 to 3 and 7 that if the diameter of the inner core is less than 29 mm, the impact resilience is reduced. In addition, it is found from Comparative Example 6 that the impact resilience is reduced also in the case where the specific gravity of the inner core is larger than that of the outer shell. Furthermore, Comparative Examples 4, 5 indicate that the impact resilience and the flying distance are reduced in the case where the hardness of the inner core at the center thereof is less than 25. In the case where the central hardness if 70 or more, the shock is remarkably increased and thus the feeling is deteriorated.

What is claimed is:

1. A three-piece solid golf ball comprising a solid core consisting of an inner core and an outer shell surrounding said inner core, and a cover covering said solid core, characterized in that the outer diameter of said inner core is 29 to 36 mm, the outer diameter of said solid core is 37 to 41 mm, a central hardness (JIS-C) of the inner core is 25 to 70, a surface hardness (JIS-C) of said outer shell is 80 to 95, a difference between said central hardness of the inner core and said surface hardness of the outer shell is 10 or more, and the relation between the specific gravity of the inner core and the specific gravity of the outer shell satisfies $1.0 <$ a specific gravity of the inner core $\leqq$ a specific gravity of the outer shel- $1 < 1.3$.

2. The golf ball according to claim 1 wherein said central hardness of the inner core is 40 to 65.

3. The golf ball according to claim 1 wherein said surface hardness of the outer shell is 85 to 92.

* * * * *